US007467502B1

(12) United States Patent
Syla

(10) Patent No.: US 7,467,502 B1
(45) Date of Patent: Dec. 23, 2008

(54) INTERLOCKING BOX SYSTEM

(76) Inventor: Hamdi R Syla, 927 Woodbridge Ct., Safety Harbor, FL (US) 34695

( * ) Notice: Subject to any disclaimer, the term of this patent is extended or adjusted under 35 U.S.C. 154(b) by 68 days.

(21) Appl. No.: 11/688,900

(22) Filed: Mar. 21, 2007

Related U.S. Application Data

(60) Provisional application No. 60/786,329, filed on Mar. 28, 2006.

(51) Int. Cl.
*E04B 1/02* (2006.01)

(52) U.S. Cl. ..... 52/588.1; 52/589.1; 52/590.2; 52/592.1; 52/592.6; 52/578; 312/263; 312/264; 312/265.5; 220/4.28; 446/127

(58) Field of Classification Search ..... 52/588.1, 52/589.1, 590.1, 590.2, 591.1, 592.1, 592.6, 52/578; 312/257.1, 263, 264, 265.5, 265.6; 220/4.28; 446/127
See application file for complete search history.

(56) References Cited

U.S. PATENT DOCUMENTS 3,410,474 A * 11/1968 Keil ..... 52/590.1
4,592,601 A * 6/1986 Hlinsky et al. ..... 312/257.1
4,703,866 A 11/1987 Scott
5,536,111 A * 7/1996 Doernemann ..... 52/590.1
5,749,196 A 5/1998 Bangma
5,775,046 A 7/1998 Fanger et al.
5,826,873 A 10/1998 Lavermicocca
6,134,853 A 10/2000 Haener
6,241,248 B1 6/2001 Winter
6,467,229 B2 10/2002 Azar
7,069,701 B2 * 7/2006 Chen ..... 52/588.1

* cited by examiner

*Primary Examiner*—Richard E Chilcot, Jr.
*Assistant Examiner*—Matthew J Smith
(74) *Attorney, Agent, or Firm*—David Kiewit

(57) ABSTRACT

Walls and other structures can be made from blocks assembled from relatively light-weight standard panels that fit together like a puzzle. The blocks are held together without the use of mortar. Each block is formed of six rectangular panels fitted together by sliding capturable elements into cooperating receiving grooves. All of the panels have a common thickness and each panel has two parallel faces. Three types of panels are involved in making the block.

5 Claims, 4 Drawing Sheets

INTERLOCKING BOX SYSTEM

REFERENCE TO OTHER APPLICATIONS

This application claims the benefit of U.S. Provisional Application No. 60/786,329, filed on Mar. 28, 2006.

BACKGROUND OF THE INVENTION

1. Field of the Invention

The invention pertains to structural elements or blocks made from interlocking panels and also to walls made by interlocking those structural elements. In addition, these structural elements can serve as building structures, toy structures, packing boxes and furniture.

2. Background Information

Conventional masonry construction commonly requires transport of heavy components, such as cinder blocks, to a building site where they are stacked and mortared together by skilled laborers. The overall construction process could thus benefit if one were to avoid transporting heavy material and, instead, use of on-site materials (e.g., sand or dirt) in making the structure. Moreover, it would be advantageous to provide a means by which a wall could be built by relatively unskilled labor and without the use of mortar.

Building blocks are also well known in the field of construction toys. Many sorts of blocks are known, with some of them involving interlocking blocks.

BRIEF SUMMARY OF THE INVENTION

One objective of the invention is to provide a means of constructing a wall or other structure by using relatively lightweight standard pieces that fit together like a puzzle and that are held together without the use of mortar.

One aspect of the invention is that it provides a block formed of six rectangular panels fitted together by sliding capturable elements on one panel into cooperating receiving grooves on another. All of the panels have a common thickness and each panel has two parallel faces. Three types of panels are involved in making the block. These are referred to as centrally grooved panels, centrally tongued panels and peripherally tongued panels, as is explained in greater detail hereinafter.

Each of the centrally grooved panel comprises at least three parallel receiving grooves extending entirely across the panel. At least one of these receiving grooves is open to a first, exterior, face and either runs along or is symmetrically spaced apart from a midline of that face. Two of the receiving grooves are open to the second, interior, face and are centered one half of the common thickness from respective edges of the panel. In addition, the edges of the centrally grooved panel are notched at the ends of the grooves formed in the first face.

Each of the centrally tongued panels comprises at least one capturable element extending part of the way across a first face of the panel. The capturable element is symmetrically disposed about a midline of the first face. This sort of panel also has two parallel receiving grooves open to the second face. Each of these receiving grooves is centered one half of the common thickness from a respective edge of the panel and runs entirely along that edge. Each centrally tongued panel also has at least one pair of edge notches aligned with the at least one capturable element.

Each of the peripherally tongued panels has a capturable element extending along each of its four edges. In some embodiments, the peripherally tongued panel may comprise other tongue or groove portions.

Another aspect of the invention is that it provides a method of building a wall from a plurality of identical blocks. Each of these blocks has two abutting faces having a selected number of respective elongate capturable elements extending outward from them. These faces may be, for example, exterior faces of the centrally tongued panels described above. Each of the blocks also has two abutting faces having the selected number of respective cooperating receiving grooves formed in them. These faces may be, for example, exterior faces of the centrally grooved panels described above. The elongate capturable elements and grooves are arranged so that each elongate capturable element is aligned with a groove on a first abutting face and with another elongate capturable element on a second abutting face. During the course of building the wall, one interlocks two blocks by sliding the elongate capturable element(s) on one block into a groove or grooves on another block so as to form a sub-assembly in which an elongate capturable element on a first of the blocks is aligned with an elongate capturable element on the second of the blocks and a groove on the first of the blocks is aligned with a groove on the second of the blocks. This process is repeated to define the wall comprising a plurality of juxtaposed interlocked columns of blocks.

An object of the invention is to provide a means by which an unskilled person can build a wall without the use of mortar.

Another object of the invention is to provide building blocks that can be assembled on site from pre-fabricated panels that can be made from a wide variety of materials.

Yet another object of some embodiments of the invention is to provide a container, made from interlocking panels, that can be used for storage or shipping or that, with small modifications, can function as an item of furniture.

Still another object of some embodiments of the invention is to provide a construction toy for children.

Although it is believed that the foregoing rather broad summary description may be of use to one who is skilled in the art and who wishes to learn how to practice the invention, it will be recognized that the foregoing recital is not intended to list all of the features and advantages. Those skilled in the art will appreciate that they may readily use both the underlying ideas and the specific embodiments disclosed in the following Detailed Description as a basis for designing other arrangements for carrying out the same purposes of the present invention and that such equivalent constructions are within the spirit and scope of the invention in its broadest form. Moreover, it may be noted that different embodiments of the invention may provide various combinations of the recited features and advantages of the invention, and that less than all of the recited features and advantages may be provided by some embodiments.

DETAILED DESCRIPTION OF A PREFERRED EMBODIMENT

Figure 1:
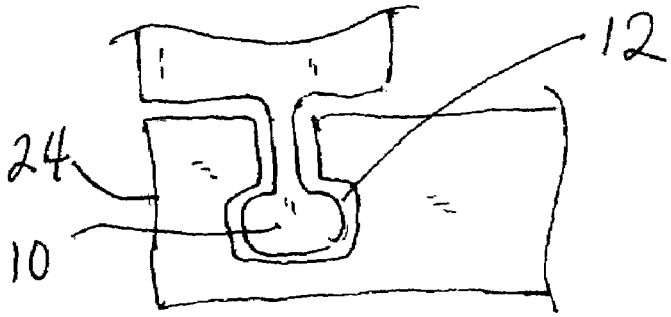
FIG. 1 is a detail view of a capturable element portion of a first panel received in a receiving groove formed in a second panel.

In studying this Detailed Description, the reader may be aided by noting definitions of certain words and phrases used throughout this patent document. Wherever those definitions are provided, those of ordinary skill in the art should understand that in many, if not most instances, such definitions apply to both preceding and following uses of such defined words and phrases. At the outset of this Description, one may note that the terms "include" and "comprise," as well as derivatives thereof, mean inclusion without limitation, and the term "or," is inclusive, meaning and/or.

In the following description, the reader will find frequent reference to elongated capturable elements 10 that cooperate with receiving grooves 12 to lock together panels 14 to form a block 16 or a structure 18 made of interlocking blocks. A key feature of these elongated elements is that they allow for assembly or disassembly by relative sliding motion along the direction of elongation, but prohibit disassembly by applying a force perpendicular to the direction of elongation to pull the two elements apart.

A receiving groove 12 may be a dovetail slide, as is commonly used in machine tool slides, may have a cross-sectional shape similar to a letter T or L, or may be a linear bearing slide in which both the groove and the capturable element received therein comprise respective ball radius grooves. Thus, a receiving groove formed in a surface provides a slot-like opening in that surface that is narrower than is a deeper part of the groove. In preferred embodiments of the invention discussed in greater detail in subsequent portions of this disclosure, the preferred receiving groove 12 has a T cross section.

A capturable element 10 may extend outwardly from a surface or edge of a panel and comprises a relatively wide portion distal from the surface or edge and connected thereto by a relatively narrow web portion. A cross-section of such an element preferably has a T shape, but may also be an inverted L, a dovetail, or any other capturable shape. In the context of the present invention, in which structures are assembled by sliding capturable elements into receiving grooves and in which relative rotation of two connected bodies is to be prohibited, each capturable element 10 is elongated. Thus, a capturable element may comprise a single capturable tongue, or may comprise a linear array of studs. In the preferred embodiment disclosed hereinafter, the preferred T-shaped capturable element is drawn as and often referred to as a tongue. Moreover, although the following description and drawing generally describe capturable elements that are integral with panel members (e.g., as would be the case if the panels were made by injection molding or extrusion), this is not a limitation, and the method and apparatus of the invention encompass panels formed by having initially separate capturable members (e.g., threaded studs) attached thereto.

A preferred embodiment of the invention employs three pairs of different types of panels 14*a*, 14*b*, 14*c* to form the six sides of a rectangular box or block 16. In this embodiment each of the panels has the same common thickness. In preferred embodiments suitable symbols, such as the letters K, O, and S, depicted in FIGS. 2*a*, 2*c*, 3*a*, 3*c*, 4*a*, and 4*b*, may be used to aid a user in recognizing various types of the panels.

Figure 2A:
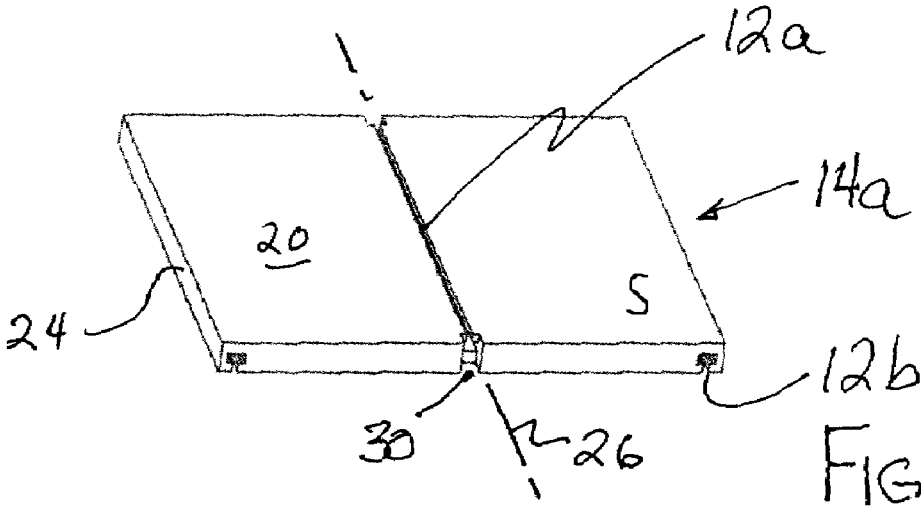
FIG. 2*a* is an elevational view of a first face of a preferred centrally grooved panel of the invention.
Figure 2B:
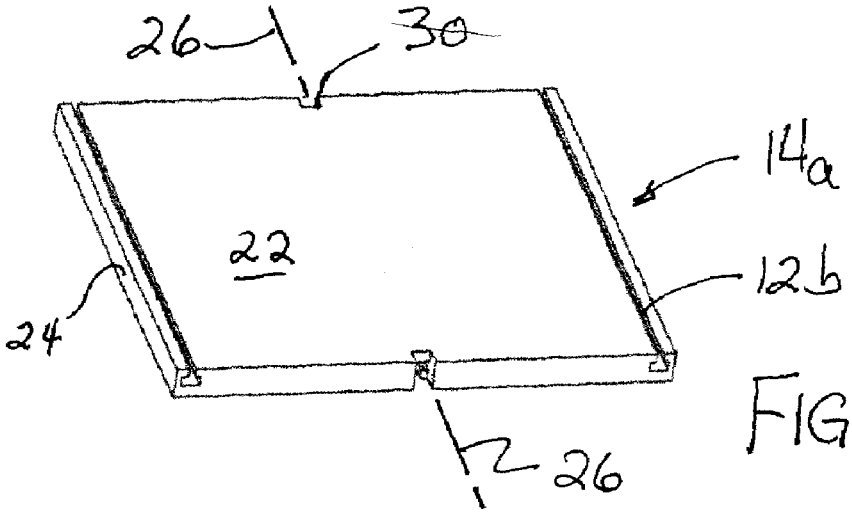
FIG. 2*b* is an elevational view of the second face of the centrally grooved panel of FIG. 2*a*.
Figure 2C:
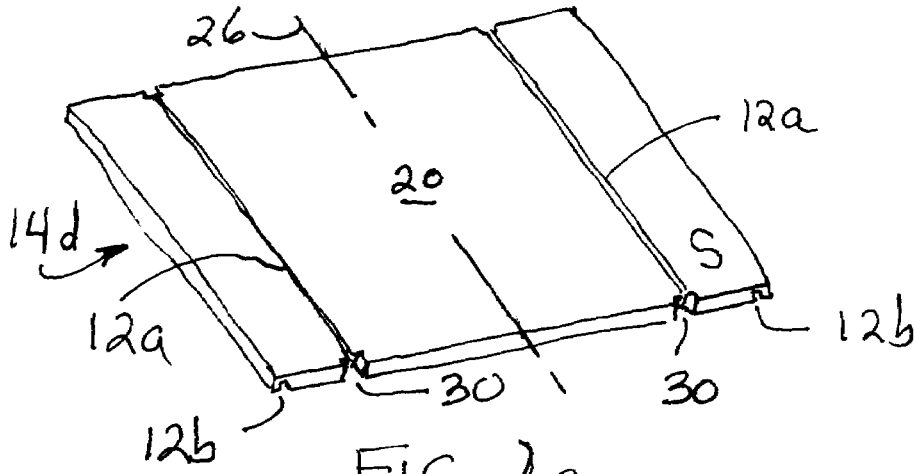
FIG. 2*c* is an elevational view of the first face of an alternate embodiment of a centrally grooved panel of the invention.

Turning now to FIGS. 2*a* and 2*b*, one finds a centrally grooved panel 14*a* having three parallel receiving grooves formed therein. A central receiving 12*a* one of these grooves is open to a first, exterior, face 20*a* of the panel 14*a* and is disposed along a midline 26 thereof. Two edge receiving grooves 12*b* are open to the second, interior, face 22 of the panel 14*a*. In this embodiment, each of the edge receiving grooves is centered one half of the common thickness from the actual edge 24 of the panel so that when a peripheral tongue 10*a* portion of a peripherally tongued panel 14*c*, centered at one half of the common thickness, is received in the edge receiving groove 12*b* the associated face 20 of the peripherally tongued panel 14*c* is flush with the edge 24. Moreover, as is common in dovetailed fittings, the height of the capturable element and the depth of the associated receiving groove are selected to ensure a flush fit at the base of the tongue.

Figure 3A:
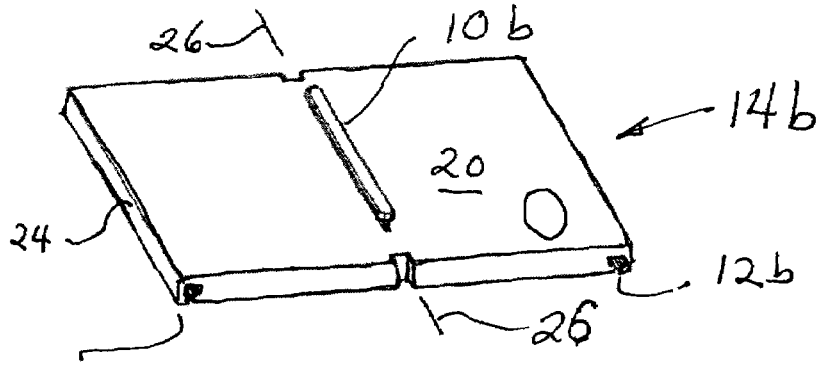
FIG. 3*a* is an elevational view of a first face of a preferred centrally tongued panel of the invention.
Figure 3B:
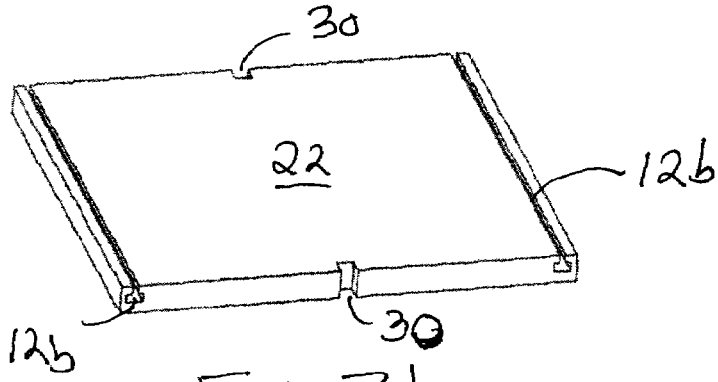
FIG. 3*b* is an elevational view of the second face of the centrally tongued panel of FIG. 3*a*.
Figure 3C:
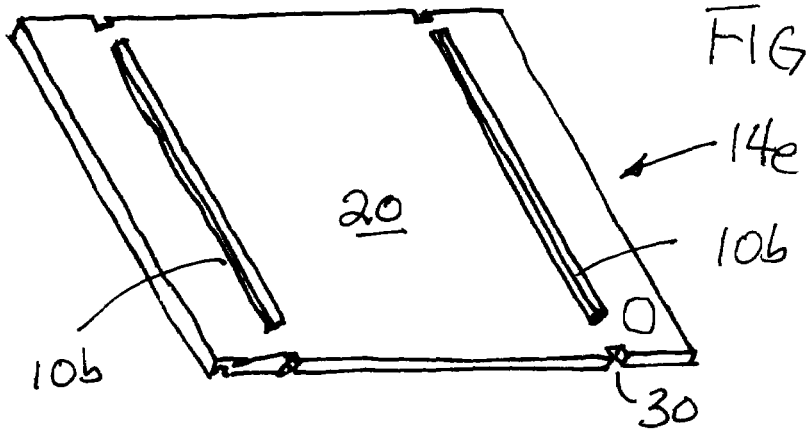
FIG. 3*c* is an elevational view of the first face of an alternate embodiment of a centrally tongued panel of the invention.
Figure 4A:
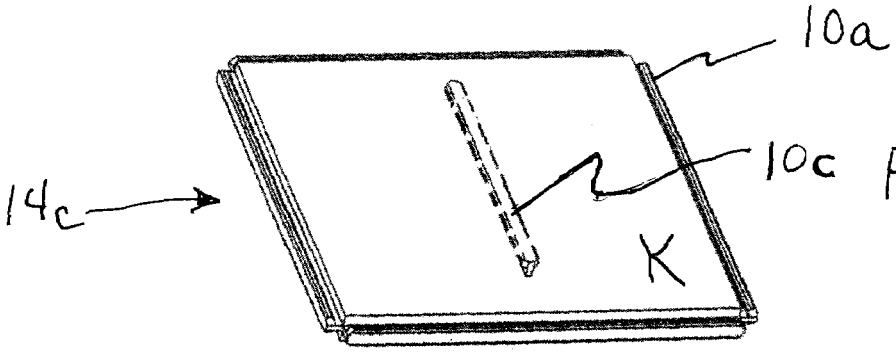
FIG. 4*a* is an elevational view of a preferred peripherally tongued panel of the invention.
Figure 4B:
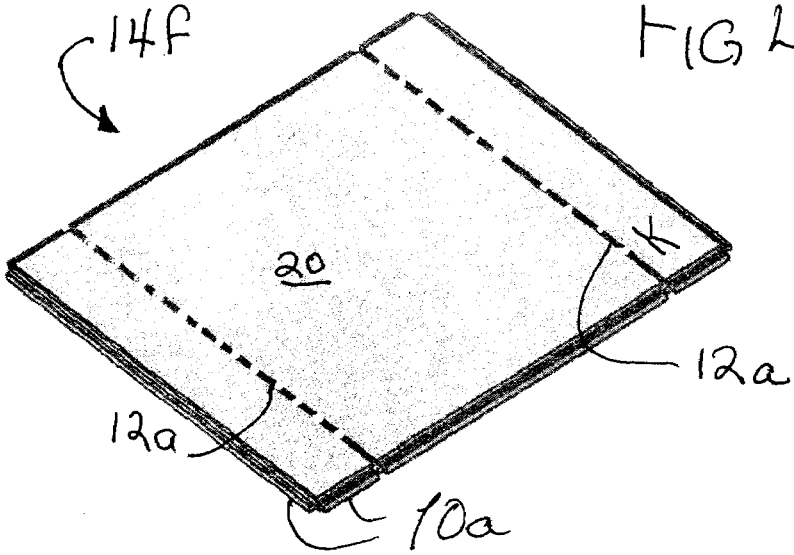
FIG. 4*b* is an elevational view of an alternate embodiment of a peripherally tongued panel of the invention.

Turning now to FIGS. 3*a* and 3*b*, one finds a centrally tongued panel 14*b* having a central tongue 10*b* extending most of the way along a midline of a first, exterior, face 20 of the panel 14*b*. As was the case for the centrally grooved pane 14*a*, the tongued panel has two edge receiving grooves 12*b* open to the second, interior, face 22 of the panel 14*b* and centered one half of the common thickness from the respective edges 24 of the panel 14*b*.

In the preferred embodiment the third panel 14*c* comprises peripheral tongues 10*a* along all four edges, each of the tongues centered within the common thickness of the panels. An optional capturable tongue or tongues, as indicated by the phantom element 10*c* in FIG. 4*a*, may be provided in a face of the peripherally tongued panel 14*c* to provide additional connectivity between blocks 16. Further, a peripherally tongued panel 14*f* having receiving grooves, as depicted in FIG. 14*b*, may also be used in some embodiments.

The invention also encompasses alternate embodiments having more than one tongue or groove running across a face. These embodiments having additional tongues and grooves may be used in situations requiring a sturdier connection between abutting blocks employed in a wall. For example, a dual-grooved panel 14*d* may have two receiving grooves parallel to and equally spaced about a midline 26 of the panel. A corresponding dual-tongued panel 14*e* has two capturable tongues correspondingly positioned. Thus, more generally, the invention encompasses panels having various numbers of tongues symmetrically disposed about respective midlines and cooperating with corresponding grooved panels. In this context, the phrase "symmetrically disposed about a midline" thus encompasses a single element running along the midline 26 as well as two or more elements equally spaced about the midline and parallel thereto.

Notches 30 are provided at selected locations in the edges of at least the centrally tongued and centrally grooved panels. In the centrally grooved panels, notches are located at both ends of each central receiving groove 12*a*. In the centrally tongued panels, notches are located along the midline—i.e., at the points at which an extension of the central tongue would intersect the edge. Each of these notches is large enough to allow a capturable element to pass through it freely.

Figure 5:
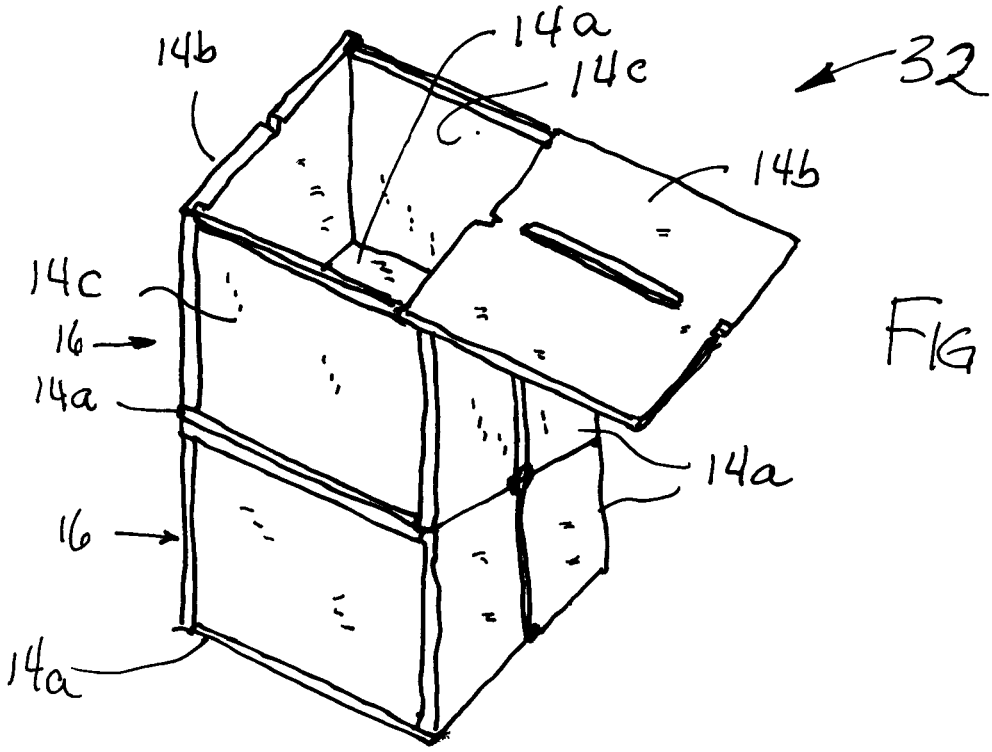
FIG. 5 is an elevational view of a portion of a wall made by interlocking blocks that are in turn made by interlocking preferred panels of the invention.

A block 16 can be assembled from pairs of the panels 14*a*, 14*b*, 14*c* by successively sliding the edge receiving grooves of the centrally tongued and centrally grooved panels onto the peripheral tongues of the peripherally tongued panel 14*c*. In order to provide a block 16 that can be interlocked with other blocks to form a wall 32 or similar structure, the relative position of the six panels is important. As depicted in FIG. 5, the two peripherally grooved panels 14*c* are set parallel to each other to form opposite sides of the block. The two centrally tongued panels 14*b* are set adjacent to each other, and are depicted in FIG. 5 as the top and left hand sides of each block. The two centrally grooved panels are also set adjacent to each other and are depicted in FIG. 5 as the bottom and right hand sides of each block.

Those skilled in the art will recognize that if the desired block is a more general rectangular parallelpiped, rather than being the depicted cube, this can be provided by choosing different sizes for the various panels. The same arrangement of tongues and grooves, however, would lead to the block of the different desired size and shape.

A wall 32, or similar structure, can be assembled by interlocking blocks 16, as depicted in FIG. 5, where each block is positioned so as to have a centrally grooved panel on its bottom and right hand side and to have a centrally tongued panel on its top and left hand side. Although the wall is depicted as being formed of columns of interlocked cubes, stacked one directly above the other, those skilled in the art will recognize that the invention is not limited to this arrangement but may encompass others as well. For example, a more conventional staggered block configuration could be obtained if one were slide the depicted cubic blocks so that a mid-point of most of the block was above the interlocked faces of two other blocks. This arrangement would, of course, require the use of some differently sized and shaped blocks to terminate the various rows. Such an arrangement is well known in conventional brick masonry, for example.

It will also be recognized that the provision of the optional tongues and grooves on the faces of some of the peripherally tongued panels, as well as the provision of appropriately located edge notches in the centrally tongued and centrally grooved panels, would allow one to construct a wall two or more blocks in thickness.

One of the advantages of the panel arrangement of the present invention is that it provides for an easily transported set of panels. The set of six panels needed to make a single block, for example, can be tightly stacked if one interlocks each centrally tongued panel with a respective one of the centrally grooved panels so as to provide a panel pair having two smooth exposed surfaces.

The blocks of the invention may be made in a wide variety of sizes for different applications. Small panels (e.g., 50 mm or so on a side) can be used as children's construction toys. Larger ones can be used for actual construction.

It should be noted that the hollow blocks of the invention can be filled with various filler materials, such as sand or dirt, that are available at a construction site.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

The invention claimed is:

1. A block formed of six rectangular panels fitted together by:

sliding capturable elements into cooperating receiving grooves, all of the panels having a common thickness, each of the panels having two parallel faces, the panels comprising a pair of centrally grooved panels, a pair of centrally tongued panels and a pair of peripherally tongued panels, wherein each centrally grooved panel comprises at least three parallel receiving grooves extending entirely across the panel, at least one of the receiving grooves open to a first face, symmetrically disposed about a midline thereof, and having a respective notch at each end thereof; and two of the receiving grooves open to the second face and centered one half of the thickness from respective edges of the panel;

each centrally tongued panel comprises at least one capturable element extending at least part of the way across a first face thereof, the capturable element symmetrically disposed about a midline of the first face; the centrally tongued panel further having two parallel receiving grooves open to the second face, each receiving groove centered one half of the thickness from a respective edge of the panel and extending entirely therealong; each centrally tongued panel further having at least one pair of edge notches aligned with a respective at least one capturable element; and each of the peripherally tongued panels has a respective capturable element extending along each of its four edges.

2. The block of claim 1 wherein each of the peripherally tongued panels further comprises at least one capturable element extending part of the way across one of the faces thereof and symmetrically disposed about a midline thereof.

3. Two or more blocks of claim 1 wherein each of the exterior surfaces of each of the blocks comprises one of the first faces of a respective one of the panels, whereby the two or more blocks can be interlocked by sliding the at least one exposed capturable element on one of the blocks into a respective receiving groove on another of the blocks.

4. The block of claim 1 wherein each centrally grooved panel comprises exactly three parallel receiving grooves, and each centrally tongued panels comprises exactly one capturable element along the midline of the first face thereof.

5. The block of claim 1 wherein each centrally grooved panel comprises exactly four parallel receiving grooves, and each centrally tongued panels comprises: two capturable elements equally spaced apart about the midline of the first face thereof.

* * * * *